US006294965B1

(12) United States Patent
Merrill et al.

(10) Patent No.: US 6,294,965 B1
(45) Date of Patent: Sep. 25, 2001

(54) STRIPLINE BALUN

(75) Inventors: Jeffrey Craig Merrill, East Syracuse; Hans Peter Ostergaard, Jamesville, both of NY (US)

(73) Assignee: Anaren Microwave, Inc., Syracuse, NY (US)

( * ) Notice: Subject to any disclaimer, the term of this patent is extended or adjusted under 35 U.S.C. 154(b) by 0 days.

(21) Appl. No.: 09/266,564

(22) Filed: Mar. 11, 1999

(51) Int. Cl.[7] ..... H01P 5/10
(52) U.S. Cl. ..... 333/26; 333/238
(58) Field of Search ..... 333/26, 238, 246; 343/859

(56) References Cited

U.S. PATENT DOCUMENTS

| | | | | |
|---|---|---|---|---|
| 3,991,390 | | 11/1976 | Conroy | 333/26 X |
| 4,193,048 | | 3/1980 | Nyhus | 333/26 |
| 4,651,344 | * | 3/1987 | Hasegawa et al. | 333/26 X |
| 4,821,007 | * | 4/1989 | Fields et al. | 333/238 |
| 5,061,910 | | 10/1991 | Bouny | 333/26 |
| 5,644,272 | | 7/1997 | Dabrowski | 333/26 |
| 5,697,088 | | 12/1997 | Gu | 333/26 X |
| 5,886,589 | * | 3/1999 | Mourant | 333/26 |

FOREIGN PATENT DOCUMENTS

0146086 * 6/1985 (EP) ..... 333/26

OTHER PUBLICATIONS

Gokdemir, T. et al., "Design and Performance of GaAs MMIC CPW Baluns Using Overlaid and Spiral Couplers," IEEE MTT–S International Microwave Symposium Digest, US, New York, NY: IEEE, Jun. 8, 1997, pp. 401–404, XP000767556 ISBN: 0–7803–3815–4.

* cited by examiner

*Primary Examiner*—Justin P. Bettendorf
(74) *Attorney, Agent, or Firm*—Bond, Schoeneck & King, LLP

(57) ABSTRACT

A surface mount balun includes a first stripline segment having a first and second end, a first balanced port connected to the first end, and a second balanced port connected to the second end, a second stripline segment overlapping and coupled to the first stripline segment, and having a third end adjacent to the first end of the first stripline segment and a fourth end disposed approximately adjacent to the center of the first stripline segment, a third stripline segment overlapping and coupled to the first stripline segment, and having a fifth end adjacent to the second end of the first stripline segment and a sixth end disposed approximately adjacent to the center of the first stripline segment, and a third, unbalanced port connected to the sixth end of the third stripline segment.

10 Claims, 4 Drawing Sheets

STRIPLINE BALUN

BACKGROUND OF THE INVENTION

This invention relates generally to stripline baluns that can be implemented in surface mount packages and more particularly to a symmetrical balun that can be fabricated in a package whose shape can be selected to conform to the requirements of a microwave circuit whose arrangement is affected by other constraints.

A balun is a passive three port electronic circuit that can be used for conversion between symmetrical (balanced) and non-symmetrical (unbalanced) transmission lines.

Baluns can be implemented in a variety of ways using different types of transmission line elements. At low frequencies, and less frequently at high frequencies, coaxial transmission line segments can be used to form baluns. For example, a quarter wavelength of coaxial cable having its outer conductor grounded at the single ended side, and an input applied to the single ended end of the quarter wave length cable will produce a balanced output between the cable conductors at the opposite end of the cable. A balanced signal applied to the non-grounded end will produce a single ended output at the grounded end. Although the performance of baluns constructed from coaxial cable is acceptable, at high frequencies the difficulties associated with accurately cutting the coaxial cable to the required length affects performance. Also, coaxial cable baluns are difficult to integrate with the other elements of microwave circuits where surface mount techniques are widely used, and are not well suited for high volume production.

Printed circuit forms of baluns have been used in an attempt to overcome some of these problems. In U.S. Pat. No. 4,193,048 a balun transformer made from stripline elements formed on a printed circuit board is described. The balun transformer is fabricated from a pair of conductors each having first and second ends located on opposite sides of the printed circuit board. The first end of each conductor is located adjacent its second end. This type of balun, while an improvement over coaxial cable baluns in very high frequency applications, is difficult to employ in high power applications, because of the proximity of large metal heat sinks associated with the amplifying transistors. Inevitably, one side of the circuit board is located closer to the metal heat sinks than the other, causing an unacceptable imbalance in paracidic capacitances applied to the balun.

U.S. Pat. No. 5,061,910 attempts to provide an improved printed circuit balun that includes a plurality of serially connected first conductor elements, preferably a contiguous merged conductor extending between a single ended signal port and ground, and a plurality of second conductor elements, also preferably in the form of a contiguous merged conductor coupled to the first conductor elements and electrically isolated therefrom, the second conductor elements extending in electrical symmetry from ground to a balanced port, the first and second conductor elements being separated by an electrical isolation layer, preferably the dielectric layer of the printed circuit board.

While an improvement over earlier circuit board baluns, the balun described in U.S. Pat. No. 5,061,910 nevertheless requires a special package which although compatible with high power transistors, is not compatible with surface mount techniques.

U.S. Pat. No. 5,697,088 describes a more recent configuration of stripline elements to form a balun useful at very high frequencies, but little is said about the construction of the balun, and no consideration of the desirability of providing the balun suitable for use in surface mount circuit arrangements appears.

U.S. Pat. No. 5,644,272 shows a balun having both distributed (stripline) elements and discrete elements combined in a multi-layer dielectric structure. The resulting balun is somewhat more complicated than desirable, and although described as being automatically mountable, does not address the particular requirements of surface mounting.

Surface mount components are designed to be mounted on a printed circuit board having printed circuit traces on at least one surface of the board. A surface mount component has terminals that are connected to the printed circuit traces by soldered connections between the terminals and the printed circuit traces. Unlike non-surface mount techniques, surface mount components do not include leads that extend through holes in the printed circuit board. Surface mount components are particularly well suited to automatic assembly. The components including the balun of this invention are mounted on continuous tapes formed into reels that are used by the automatic assembly equipment to place the components on the printed circuit board. Typically, the components are temporarily attached to the board with an adhesive, solder paste, or the like prior to soldering, and then soldered in a single operation with the other surface mount components. In order to permit the surface mount component to be heat sinked, the paracidic capacitance problems of printed circuit baluns of the type described before must be overcome.

In surface mount applications, it is desirable to provide a circuit arrangement that can be implemented in a package that can be configured in a shape compatible with the other elements of the circuit. It is desirable to provide the balanced input ports and the unbalanced output port of the balun on opposite ends of the surface mount package. It is also desirable to provide a balun that can have a symmetrical physical shape that can be adjusted in length and width to physically fit within a particular circuit arrangement.

SUMMARY OF THE INVENTION

It is an object of this invention to provide a surface mount balun that can be provided to automatic surface mounting equipment in a taped and reeled form. It is another object of the invention to provide a surface mount balun having a common ground plane for permitting the balun to be heat sinked without creating unsymmetrical parasitic capacitances.

It is another object of the invention to provide a surface mount balun that can be manufactured in a variety of symmetrical physical shapes, so as to adapt to differing circuit layouts.

It is yet another object of the invention to provide a surface mount balun where the input is located at or near the center of one narrow side, and the balanced outputs are on the opposite narrow side.

It is yet another object of the invention to provide a surface mount balun where the input is located at or near the center of one wide side, and the balanced outputs are on the opposite wide side.

Briefly stated, and in accordance with a presently preferred embodiment of the invention, a surface mount balun includes a first stripline segment having a first and second end, a first balanced port connected to the first end, and a second balanced port connected to the second end, a second stripline segment overlapping and coupled to the first stripline segment, and having a third end adjacent to the first end of the first stripline segment and a fourth end disposed approximately adjacent to the center of the first stripline segment, a third stripline segment overlapping and coupled to the first stripline segment, and having a fifth end adjacent to the second end of the first stripline segment and a sixth end disposed approximately adjacent to the center of the first stripline segment, and a third, unbalanced port connected to the sixth end of the third stripline segment.

In accordance with a further aspect of the invention, a first ground plane is coupled to the second and third stripline segments, and the first stripline segment is made wider than the second and third stripline segments so that it acts as a ground plane with respect to those segments.

In accordance with another aspect of the invention, first and second ground planes are coupled to the first stripline segment and to the second and third stripline segments respectively, the ground planes forming the outer surfaces of the surface mount package.

In accordance with another aspect of the invention, the third, fourth and fifth ends of the stripline segments are connected to at least one, and preferably both of the ground planes by electrical connections in the form of plated through holes.

In accordance with another aspect of the invention, the surface mount balun includes a body of dielectric material disposed between the first and second ground planes, and the first, second and third stripline segments are disposed within the dielectric body, the first stripline segment being disposed on one layer parallel to the planes of the ground planes, and the second and third stripline segments formed in a second layer parallel to the one layer.

In accordance with a further aspect of the invention, the first strip line segment is formed in a generally U-shaped configuration with first and second ends terminating adjacent a first edge of the stripline package, and the center of the U-shaped first stripline segment being disposed adjacent the second opposite edge of the stripline package. The second and third stripline segments overlap respective opposite halves of the first stripline segment, and have third and fifth ends respectively terminating at the first edge, and fourth and sixth ends respectively terminating at the second edge of the stripline package.

In accordance with still another aspect of the invention, the first and second ends of the first stripline segment terminate in 25 ohm electrical surface mount contacts, and the sixth end of the third stripline segment terminates in a 50 ohm electrical stripline contact. While 50 and 25 ohm ports are widely used, the invention is not limited to any particular combination of impedances.

BRIEF DESCRIPTION OF THE DRAWINGS

The novel aspects of the invention are set forth with particularity in the appended claims. The invention itself, together with further objects and advantages thereof may be more readily comprehended by referring to the following detailed description of a presently preferred embodiment of the invention, taken in conjunction with the accompanying drawing, in which:

DETAILED DESCRIPTION OF THE PREFERRED EMBODIMENT

Figure 1:
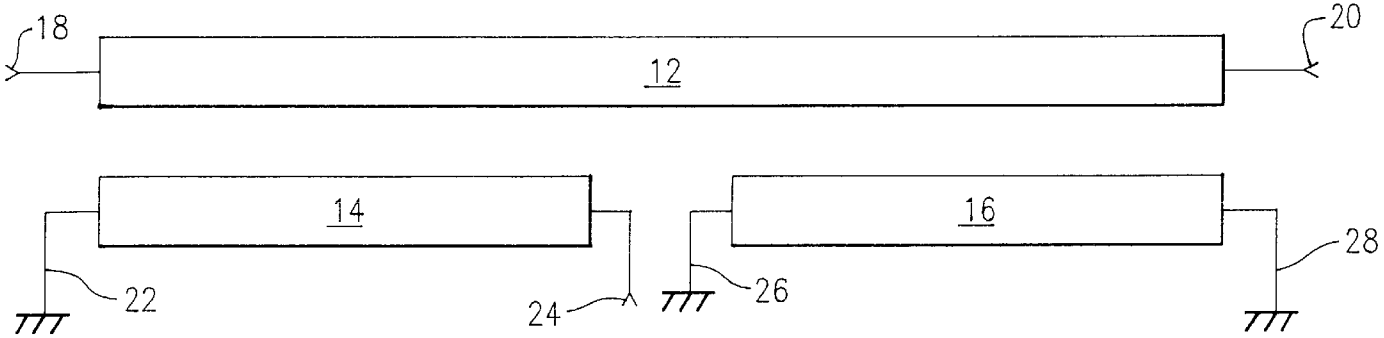
FIG. 1 is a schematic diagram of a stripline balun in accordance with this invention.

Referring now to FIG. 1, a surface mount balun in accordance with this invention is illustrated in diagrammatic/schematic form. The balun includes first, second and third stripline segments 12, 14 and 16 respectively. It will be understood that each stripline segment preferably comprises a layer of conductive material on a dielectric substrate and an opposed ground plane, separated from the layer of conductive material by the substrate. Preferably, the layer of conductive material is copper and the dielectric substrate is a PTFE based material, such as Rogers 3003, available from Rogers Corporation of Chandler, Ariz. The impedance of the stripline segments is determined by the dimensions of the segments, and the nature of the dielectric material. The selection of materials and the design of stripline segments with desired impedance characteristics is itself known to those skilled in the art.

In accordance with a preferred embodiment of the invention, for a balun having a nominal operating frequency of 1.9 Ghz, stripline segments 14 and 16 are each ¼ wavelength long, and have a width of 0.050 inches. Stripline segment 12 is ½ wavelength long, and has a width of 0.032 inches.

A first balanced input port 18 is connected to one end of stripline segment 12, and a second balanced input port 20 is connected to the opposite end of stripline section 12. Stripline section 14 is connected to ground by an electrical connection 22 at one end thereof, and is connected to an unbalanced input port 24 at the other end thereof. Stripline section 16 is connected to ground by electrical connections 26 and 28 respectively at first and second ends thereof. Stripline section 14 is arranged with one end overlapping and coupled to the end of stripline section 12, but is connected to balanced input port 18 and stripline section 16 is arranged to overlap and be coupled to the opposite end of stripline section 12, which is connected to balance input port 20.

Figure 2:
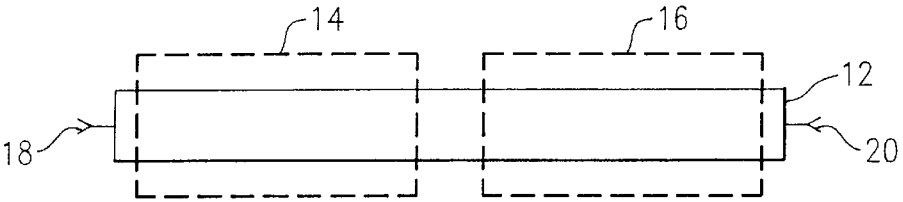
FIG. 2 is a conceptual top plan view of a stripline balun in accordance with the invention.

A top view of a balun in accordance with this invention is shown in FIG. 2. As in FIG. 1, the ground planes are omitted for ease of illustration. In this and the other figures, like reference numbers designate the same or similar elements of the invention.

As can be seen in FIG. 2, stripline segments 14 and 16 are preferably at least slightly wider than stripline segment 12. Stripline segments 14 and 16 overlap the end portions of stripline segment 12 adjacent the balanced input ports 18. Preferably, the ends of stripline segment 12 at which the contacts for ports 18 and 20 are formed extend at least slightly beyond the ends of stripline segments 14 and 16.

Figure 3:
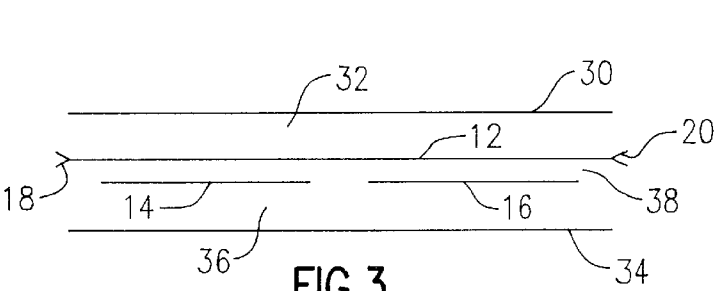
FIG. 3 is a side section view of the balun of FIG. 2.
Figure 4:
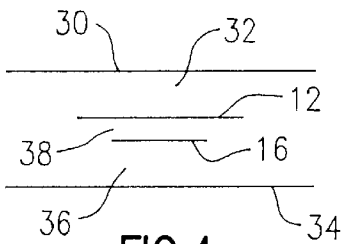
FIG. 4 is an end section view of the balun of FIG. 2.

The ground planes associated with the stripline segments 12, 14 and 16 are shown in FIG. 3. A first ground plane 34 is spaced from stripline segments 14 and 16 by a second dielectric layer 36. A second, optional ground plane 30 is spaced from stripline segment 12 by a dielectric layer 32. When only the first ground plane 31 is used, the stripline segment 12 acts as a ground plane for stripline segments 14 and 16. To enhance the effectiveness of stripline segment 12 as a ground plane, it is preferably made wider than stripline segments 14 and 16. Stripline segments 14 and 16 are spaced from each other by a third dielectric layer 35. FIG. 4 shows an end view of the surface mount balun in accordance with the invention in which the slightly greater width of stripline segment 12 compared with stripline segment 16 (and stripline segment 14) can be seen.

Figure 5:
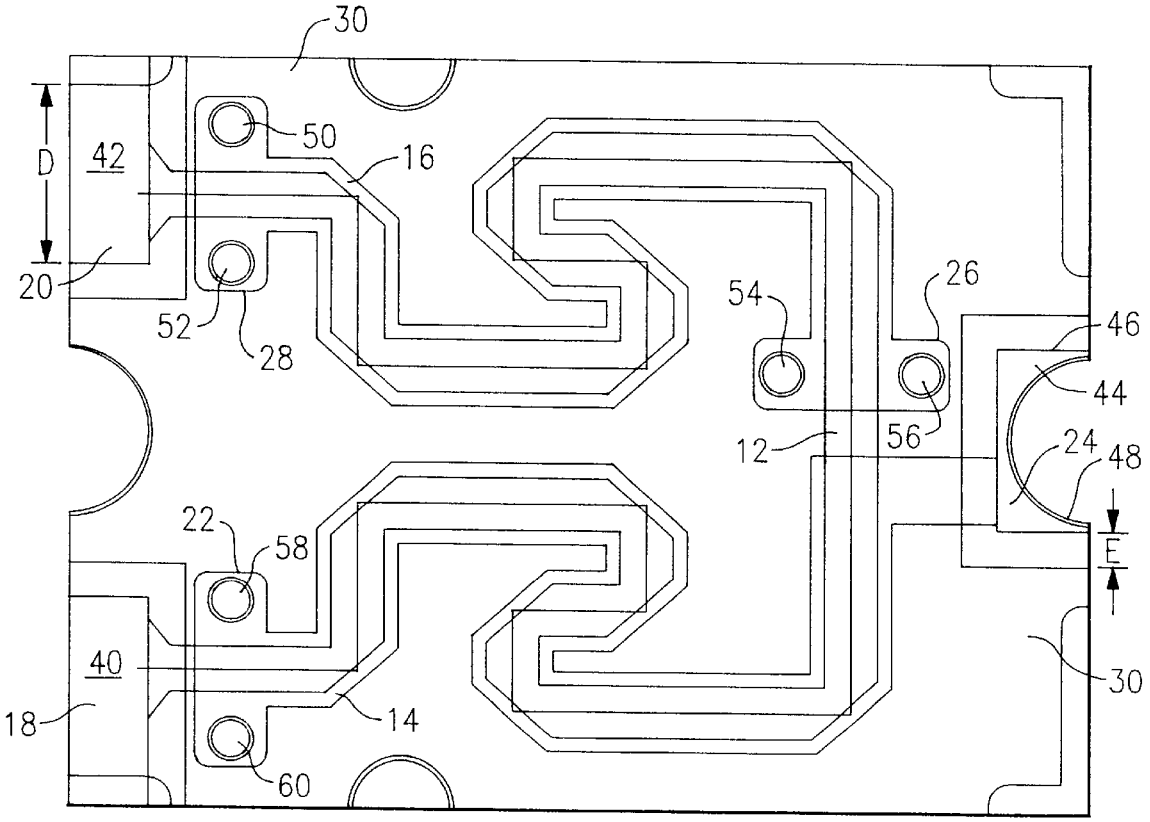
FIG. 5 is a top plan view of a preferred embodiment of the invention.

A top plan view of a balun in accordance with the invention is shown in FIG. 5. While FIGS. 1–4 were diagrammatic and conceptual in nature, FIG. 5 shows the layout of an actual embodiment of the invention. Balanced input ports 18 and 20 are connected to the ends of stripline segment 12, which is arranged in a symmetrical serpentine of configuration to reduce the size of the balun.

The balanced input ports 18 and 20 include generally rectangular surface mount contacts 40 and 42 respectively, which are adapted to be soldered to circuit traces on a surface mountable substrate. Preferably, the dimensions of contacts 40 and 42 are selected to provide an impedance at the operating frequency of the balun that matches the impedance of the circuit in which the balun is used. The impedance can be adjusted by adjusting the dimensions of the contact 42, particularly the width D of the contact.

Unbalanced port 24 has a contact 44 that is preferably selected to have an impedance approximately twice the impedance of contacts 40 and 42. Preferably, contact 44 has a rectangular inner periphery 46 and a semi-circular outer periphery 48. The dimensions of contact 44 particularly the width can be adjusted to provide an impedance that matches the impedance of the circuit to which the balun is connected. While the balanced ports have been described as the input ports, and the unbalanced port has been referred to as the output port, it will be understood that this is merely for convenience, and either the balanced or the unbalanced port(s) can be the input, or the output of the balun.

The connections between the ends of stripline segments 14 and 16, and ground planes 30 and 31 are made by way of plated through holes or vias. For example, vias 50 and 52 extend from ground plane 30 through stripline segment 16 to ground plane 31. A low impedance electrical connection is thereby formed between the end of stripline segment 16 and ground planes 30 and 31, which are also connected together. Similarly, vias 54 and 56 form a connection between the ground planes and the opposite end of stripline segment 16. Vias 58 and 60 connect one end of stripline segment 14 to ground planes 30 and 31, the opposite end being connected to unbalanced output port 24.

As can be seen easily in FIG. 5, stripline section 12 is essentially symmetrical about a horizontal center line of the balun. Similarly, stripline sections 14 and 16 are substantially symmetrical about the same center line. The lengths of the stripline segments are determined by the operating frequency of the balun. The stripline segments may be arranged in a meandering or serpentine manner, as shown in FIG. 5 to reduce the overall size of the surface mount package.

Figure 6:
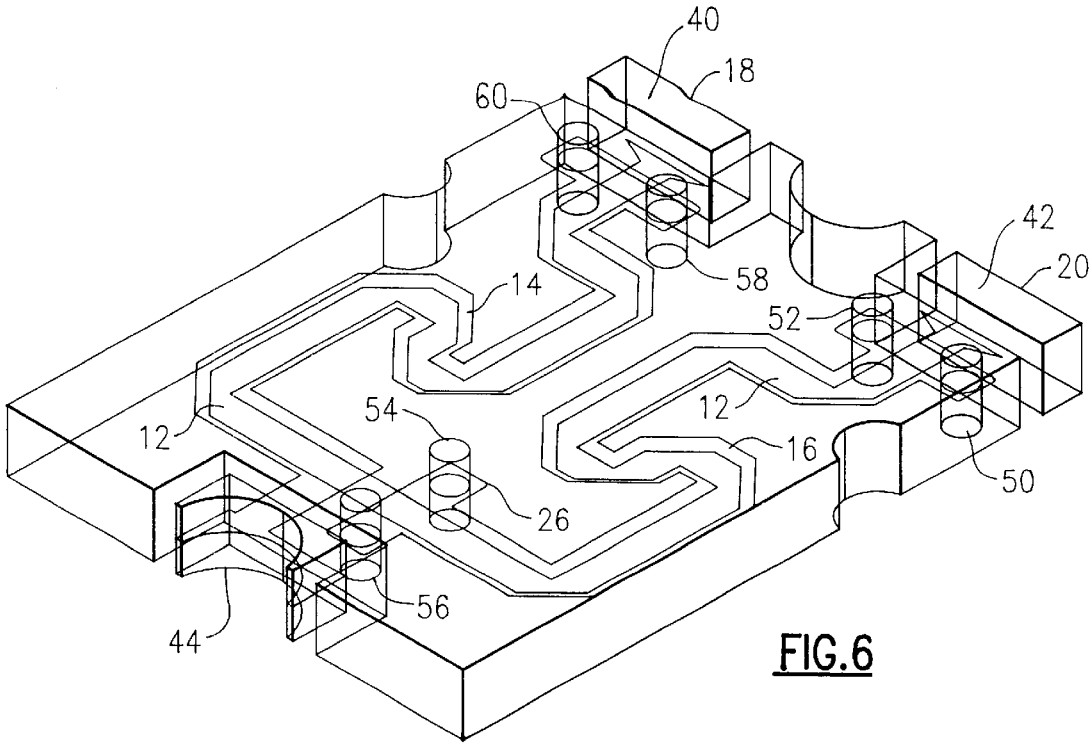
FIG. 6 is a bottom perspective view of the balun of FIG. 5.
Figure 7:
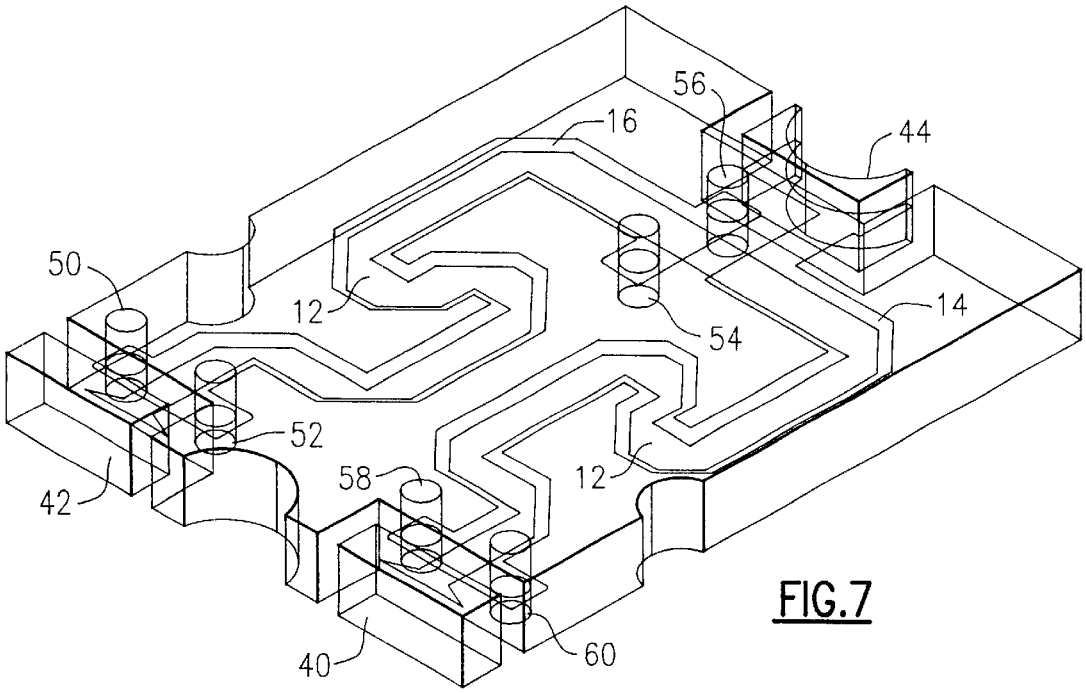
FIG. 7 is a top perspective view of the balun of FIG. 5.

FIGS. 6 and 7 are top and bottom perspective views of a surface mount balun in accordance with the invention. The plated through holes 50, 52, 54, 56, 58 and 60 can be easily seen in FIGS. 6 and 7, as can the arrangement of the contacts 40, 42, and 44.

Figure 8:
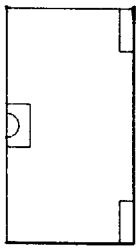
FIGS. 8–10 are diagrammatic views of different configurations of the stripline balun in accordance with this invention.
Figure 9:
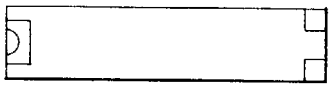
Figure 10:
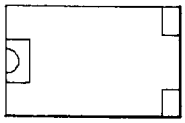

FIGS. 8, 9, and 10 show alternate package configurations, all achievable using the configuration of FIG. 5 and rearranging the stripline segments to fit within the package outlines shown.

Figure 11:
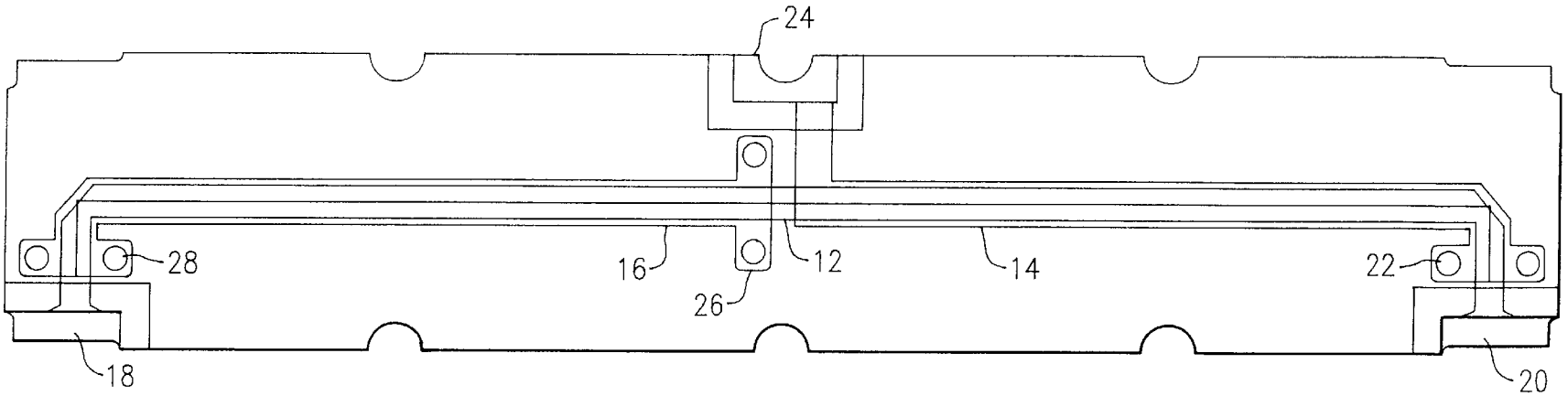
FIG. 11 is a top plan view of an alternative embodiment of the invention.

FIG. 11 is a top plan view of a balun in accordance with another embodiment of the invention. In FIG. 11 the package is substantially wider than it is long. The stripline segment 12 is a very wide, shallow U-shape, extending over substantially the entire width of the package. The stripline segments 14 and 16 are slightly wider, as described in more detail above.

A first balanced input port 18 is connected to one end of stripline segment 12, and a second balanced input port 20 is connected to the opposite end of stripline section 12. Stripline section 14 is connected to ground by an electrical connection 22 at one end thereof, and is connected to an unbalanced input port 24 at the other end thereof. Stripline section 16 is connected to ground by electrical connections 26 and 28 respectively at first and second ends thereof. Stripline section 14 is arranged with one end overlapping and coupled to the end of stripline section 12, but is connected to balanced input port 18 and stripline section 16 is arranged to overlap and be coupled to the opposite end of stripline section 12, which is connected to balanced input port 20.

While the invention has been described in connection with a presently preferred embodiment thereof, those skilled in the art will recognize that many modifications and changes may be made therein, without departing from the true spirit and scope of the invention, which accordingly is intended to be defined solely by the appended claims.

What is claimed:

1. A surface mount balun comprising:

a) a first layer of dielectric material;

b) a first ground plane formed on a first surface of said first layer;

c) a second layer of dielectric material having a first surface and a second surface;

d) a third layer of dielectric material having a second ground plane formed thereon;

e) a first stripline segment having a first end connected to a first port and a second end connected to a second port, said first stripline segment formed on said first surface of said second layer of dielectric material;

f) a second stripline segment having a third and a fourth end, and a third stripline segment having a fifth and a sixth end, both of said second and third stripline segments formed on said second surface of said second layer of dielectric material;

g) wherein said first stripline segment has a first end connected to a first port, said first port disposed on an edge of the surface mount balun, and wherein said first stripline segment has a second end connected to a second port, said second port disposed on the first edge of the surface mount balun;

h) wherein said fourth end is connected to a third port, said third port disposed on the edge of the surface mount balun; and i) wherein said third end, fourth end and fifth end are each electrically connected to at least one of said firsts and second ground planes.

2. The balun of claim 1 wherein said first stripline segment is generally U-shaped.

3. The balun of claim 1 comprising a surface mountable package.

4. The balun of claim 1 wherein said second and third stripline segments are substantially coplanar.

5. The balun of claim 1 wherein said first stripline segment is disposed in a plane generally parallel to and spaced apart from a plane containing the second and third stripline segments.

6. A surface mount balun comprising:

a) a first layer of dielectric material;

b) a first ground plane formed on a first surface of said first layer;

c) a second layer of dielectric material having a first surface and a second surface;

d) a third layer of dielectric material having a second ground plane formed thereon;

e) a first stripline segment having a first end connected to a first port and a second end connected to a second port, said first stripline segment formed on said second surface of said first layer of dielectric material;

f) a second stripline segment having a third and a fourth end, and a third stripline segment having a fifth and a sixth end, both of said second and third stripline segments formed on said first surface of said third layer of dielectric material;

g) wherein said first stripline segment has a first end connected to a first port, said first port disposed on an edge of the surface mount balun, and wherein said first stripline segment has a second end connected to a second port, said second port disposed on the edge of the surface mount balun;

h) wherein sixth end is connected to a third port, said third port disposed on the edge of the surface mount balun; and i) wherein said third end, fourth end and fifth end are each electrically connected to at least one of said first and second ground planes.

7. The balun of claim 6 wherein said first stripline segment is generally U-shaped.

8. The balun of claim 6 comprising a surface mountable package.

9. The balun of claim 6 wherein said second and third stripline segments are substantially coplanar.

10. The balun of claim 6 wherein said first stripline segment is disposed in a plane generally parallel to and spaced apart from a plane containing the second and third stripline segments.

* * * * *